US007541944B2

(12) United States Patent
Konya et al.

(10) Patent No.: US 7,541,944 B2
(45) Date of Patent: Jun. 2, 2009

(54) SYSTEMS AND METHODS FOR COLLISION AVOIDANCE

(75) Inventors: Kazuhide Konya, Mercer Island, WA (US); Todd B. Brouwer, Duvall, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/889,200

(22) Filed: Jul. 12, 2004

(65) Prior Publication Data

US 2006/0007021 A1 Jan. 12, 2006

(51) Int. Cl.
*G08B 21/00* (2006.01)

(52) U.S. Cl. ..... 340/945; 340/933; 340/936; 701/301

(58) Field of Classification Search ..... 340/435, 340/933, 958, 961, 995.26, 945, 936; 701/301; 342/70–72, 36, 63
See application file for complete search history.

(56) References Cited

U.S. PATENT DOCUMENTS

| | | | | |
|---|---|---|---|---|
| 3,814,211 | A | 6/1974 | Pamer | |
| 4,931,930 | A | 6/1990 | Shyu et al. | |
| 5,004,997 | A | 4/1991 | Shisgal et al. | |
| 5,051,815 | A * | 9/1991 | Hidaka | 257/659 |
| 5,291,196 | A * | 3/1994 | Defour | 340/961 |
| 5,548,515 | A | 8/1996 | Pilley et al. | |
| 5,740,047 | A | 4/1998 | Pilley et al. | |
| 5,793,491 | A * | 8/1998 | Wangler et al. | 356/613 |
| 5,889,479 | A | 3/1999 | Tabel | |
| 5,940,012 | A | 8/1999 | Studebaker | |
| 6,118,401 | A * | 9/2000 | Tognazzini | 342/29 |
| 6,294,985 | B1 | 9/2001 | Simon | |
| 6,405,975 | B1 * | 6/2002 | Sankrithi et al. | 244/1 R |
| 6,462,697 | B1 | 10/2002 | Klamer et al. | |
| 6,642,839 | B1 * | 11/2003 | Gunderson et al. | 340/435 |
| 2002/0105432 | A1 * | 8/2002 | Pederson et al. | 340/815.45 |
| 2003/0122666 | A1 | 7/2003 | John et al. | |
| 2005/0285774 | A1 * | 12/2005 | Wittenberg et al. | 342/70 |

FOREIGN PATENT DOCUMENTS

EP 0 690 315 B1 5/2001

* cited by examiner

*Primary Examiner*—Benjamin C Lee
*Assistant Examiner*—Hongmin Fan

(57) ABSTRACT

Systems and methods for collision avoidance are disclosed. In one embodiment, a method includes providing a proximity warning system operatively coupled to the aircraft and adapted to monitor a scanning area proximate a selected portion of the aircraft. The scanning area is monitored using the proximity warning system. A ground-based device within the scanning area is detected using the proximity warning system, and a distance between the ground-based device and the selected portion on the aircraft is determined using the proximity warning system. If the distance between the ground-based device and the selected portion does not exceed a selected minimum distance, then a warning signal is provided. In alternate embodiments, the proximity warning system provides a second warning signal distinguishable from the warning signal.

8 Claims, 3 Drawing Sheets

SYSTEMS AND METHODS FOR COLLISION AVOIDANCE

FIELD OF THE INVENTION

This invention relates to collision avoidance systems, and more specifically, to systems and methods for collision avoidance between aircraft and ground-based service equipment.

BACKGROUND OF THE INVENTION

Passenger aircraft generally require the performance of a variety of different tasks following the termination of a specific flight. Typically, the aircraft must be refueled, cargo must be unloaded, the cabin of the aircraft must be cleaned, the lavatory wastewater must be removed, and the galley must be re-provisioned, among other tasks. Consequently, during the performance of various ground service operations, a plurality of service vehicles may be maneuvering and/or positioned about the aircraft. A risk therefore exists that a service vehicle may inadvertently collide with a portion of the aircraft while moving about the aircraft. Such a collision may result in significant damage to the aircraft, requiring a costly and time-consuming repair before the aircraft is returned to service.

Since non-metallic composite components are increasingly replacing conventional metallic structures on passenger aircraft in order to reduce weight, the likelihood that significant damage may result from a ground service vehicle collision has accordingly increased. Moreover, selected portions of the aircraft are particularly susceptible to damage while the aircraft is positioned on the ground. For example, landing gear doors, cargo loading doors and passenger access doors are generally maintained in an open position during ground operations, and may be relatively easily damaged by even a minor collision. Even in cases where damage to the aircraft is less significant, relatively expensive flight delays are often incurred since a mandated inspection of the damaged area must be performed to determine if the damage is within allowable limits.

One conventional method of reducing the possibility of undesirable collisions is to increase the minimum clearance criteria around the aircraft for vehicle maneuver. For example, FIG. 1 is a top elevational view of an aircraft 100 being serviced by ground support vehicles in accordance with the prior art. The aircraft 100 includes a fuselage 102 having left and right forward doors 104, 106 positioned ahead of the wings 108, and a left rear door 110 positioned aft of the wings 108. In operation, a passenger loading bridge 114 passes an engine 112 positioned on the left wing 108 by a critical clearance 116 as it approaches the left forward door 104 to load and unload passengers. Similarly, a first galley truck 118 passes an engine 112 positioned on the right wing 108 by the critical clearance 116 as it approaches the right forward door 106, and a second galley truck 120 passes a trailing edge flap of the left wing 108 by the critical clearance 116 as it approaches the left rear door 110.

A conventional minimum clearance 116 between the wing 108 of an aircraft 100 and a galley truck 120 maneuvering behind it to dock at the left rear door 110 of the aircraft 100 is presently 3 feet. Due to the increased costs associated with the repair of composite wing structures, however, a conventional approach to reducing the possibility of collision is to increase this minimum clearance, for example, to 5 feet. Unfortunately, merely increasing the minimum clearance criteria around the aircraft may lead to additional difficulties and expense, and may render some equipment and facilities unusable. For example, door 110 may become out of reach by the second galley truck 120 approaching it from behind the wing trailing edge. Accordingly, improved systems and methods for reducing the possibility of collision between a ground service vehicle and an aircraft without increasing the minimum clearance criteria would be beneficial.

SUMMARY OF THE INVENTION

The present invention is directed to systems and methods for collision avoidance between aircraft and ground-based service equipment. Embodiments of apparatus and methods in accordance with the present invention may advantageously reduce the possibility of collision between a ground service vehicle and an aircraft without increasing the minimum clearance criteria, thereby reducing costs associated with repairs and enabling the use of conventional ground-based servicing equipment and facilities. Thus, embodiments of the present invention allow a door, such as galley door 110 shown in FIG. 1, to be serviceable without moving the door aft.

In one embodiment, a method of reducing a likelihood of a collision between an aircraft and a ground-based device includes providing a proximity warning system operatively coupled to the aircraft and adapted to monitor a scanning area proximate a selected portion of the aircraft. The method further includes monitoring the scanning area using the proximity warning system, and moving the ground-based device into the scanning area. The ground-based device is detected within the scanning area using the proximity warning system, and a distance between the ground-based device and the selected portion on the aircraft is determined using the proximity warning system. If the distance between the ground-based device and the selected portion falls below a selected minimum distance, then a warning signal is provided. In alternate embodiments, the proximity warning systems includes a laser scanning system, a laser radar system, a laser-based imaging system, a laser radar system, an infrared global positioning system, and a laser-based point tracking system

BRIEF DESCRIPTION OF THE DRAWINGS

The preferred and alternative embodiments of the present invention are described in detail below with reference to the following drawings.

DETAILED DESCRIPTION OF THE INVENTION

The present invention relates to systems and methods for collision avoidance between aircraft and ground-based service equipment. Many specific details of certain embodiments of the invention are set forth in the following description and in FIGS. 2-3 to provide a thorough understanding of such embodiments. One skilled in the art, however, will understand that the present invention may have additional embodiments, or that the present invention may be practiced without several of the details described in the following description.

Generally, embodiments of systems and methods in accordance with the present invention may accurately measure the clearance between a moving service vehicle or other ground-based equipment and an aircraft stationed on the ground, and may assist an operator of the ground-based equipment with maintaining a minimum clearance and avoiding a collision with the aircraft. In one particular embodiment, when the critical clearance (e.g. 3 feet) is reached, a system in accordance with the invention will warn the operator that the minimum clearance has been reached.

Figure 2:
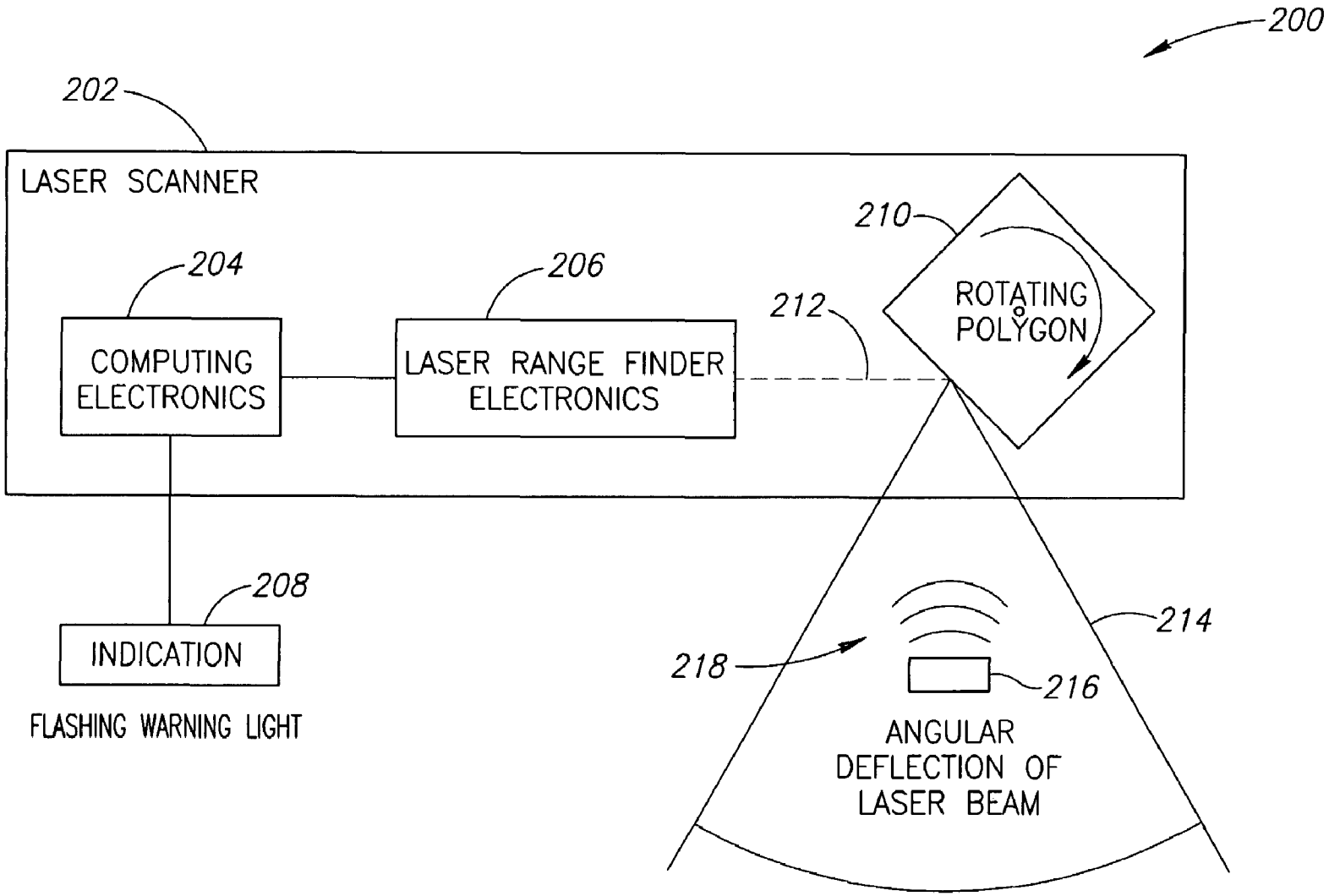
FIG. 2 is a schematic view of a collision avoidance system in accordance with an embodiment of the invention.

FIG. 2 is a schematic view of a collision avoidance system 200 in accordance with an embodiment of the invention. In this embodiment, the collision avoidance system 200 includes a laser scanner 202 having a controller 204 operatively coupled to a laser rangefinder 206 and to a warning indicator 208. A scanning assembly 210 is adapted to receive a laser beam 212 emitted by the laser rangefinder 206, and to transmit, reflect, or refract the laser beam 212 over a scanning area 214. In one particular embodiment, the scanning assembly 210 includes a rotating polygonal refractive lens.

Figure 3:
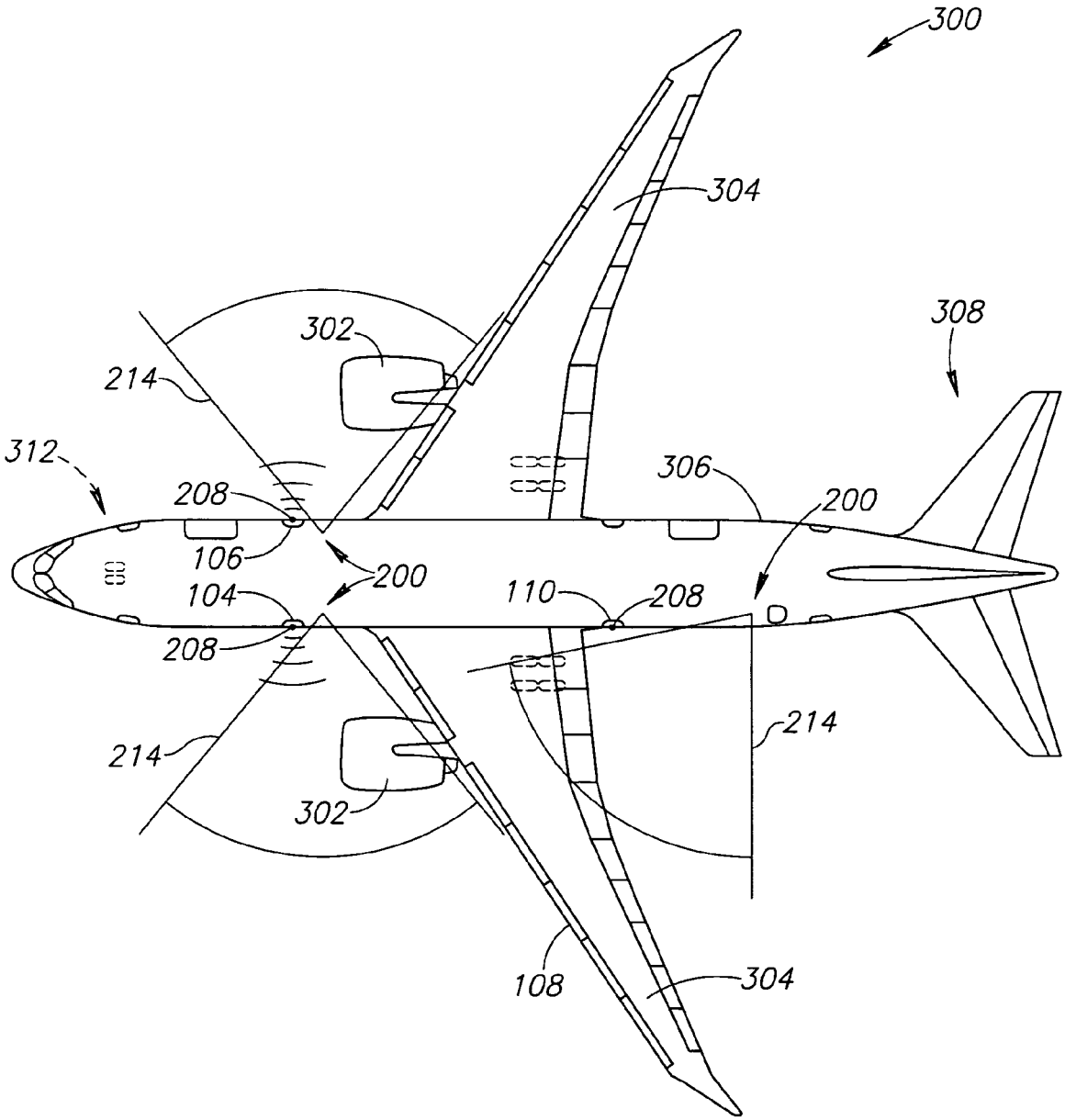
FIG. 3 is a top elevational view of an aircraft equipped with a plurality of collision avoidance systems in accordance with another embodiment of the invention.

FIG. 3 is a top elevational view of an aircraft 300 equipped with a plurality of collision avoidance systems 200. In this embodiment, the scanners 202 are located at the origin of each scanning area 214, and the warning indicators 208 (e.g. flashing lights) are located near the doors of the aircraft 300 to warn the drivers of approaching vehicles if their vehicle gets too close to a respective portion of the aircraft 300. With the exception of the collision avoidance systems 200, the aircraft 300 includes components and subsystems generally known in the pertinent art, and in the interest of brevity, will not be described in detail. As shown in FIG. 3, the aircraft 300 generally includes one or more propulsion units 302 that are coupled to wing assemblies 304, or alternately, to a fuselage 306 or even other portions of the aircraft 300. A tail assembly 308 is coupled to the fuselage 306, and a flight control system 312 is operatively coupled to the propulsion units 302, the wings 304, and the tail assembly 308. Additionally, the aircraft 300 includes a host of other systems and subsystems generally required for the proper operation of the aircraft 300.

Although the collision avoidance systems 200 are depicted in the embodiment shown in FIG. 3 as being coupled to the fuselage 306, in alternate embodiments, the systems 200 may be positioned at any desired location on the aircraft 300. For example, in alternate embodiments, the collision avoidance systems 200 may be positioned on the wings 304, the propulsion units 302, the tail assembly 308, or any other suitable portion of the aircraft 300.

The aircraft 300 shown in FIG. 3 is generally representative of a commercial passenger aircraft, such as the 7E7 aircraft commercially-available from The Boeing Company of Chicago, Ill. In alternate embodiments, however, collision avoidance systems 200 in accordance with the present invention may be incorporated onto a wide variety of aircraft types, including military aircraft, cargo aircraft, rotary aircraft, and any other desired flight vehicles. Examples of such flight vehicles may include those aircraft described, for example, in Jane's All The World's Aircraft, available from Jane's Information Group, Ltd. of Coulsdon, Surrey, UK.

With reference to FIGS. 2 and 3, in operation, the controller 204 of each of the laser scanners 200 transmits a first control signal to the laser rangefinder 206 to initiate the laser beam 212. The laser beam 212 is directed by the scanning assembly 210 over the scanning area 214. When an object 216 (e.g. a galley truck, a luggage mover, a fuel truck, a passenger loading bridge, etc.) enters the scanning area 214, reflected light 218 is reflected from the object 216 back to the laser rangefinder 206. The laser rangefinder 206 then determines the distance from a suitable reference point (e.g. the laser scanner 202) to the object 216 and transmits corresponding range indication signals to the controller 204. Alternately, the laser rangefinder 206 may simply transmit the range indication signals to the controller 204, and the controller 204 may determine the corresponding distance. After the distance from the reference point to the object 216 is determined, the controller may transmit a corresponding warning control signal to the warning indicator 208. The warning indicator 208 may then provide a visual warning, an audible warning, or both, to indicate the position of the object 216 within the scanning area 214 or relative to the reference point.

For example, in one embodiment, the warning indicator 208 provides a flashing light that begins when the object 216 is determined to be at a first selected distance (e.g. 3 feet) from the reference point, and provides a constant light when the object 216 reaches a second selected distance (e.g. 2 feet) from the reference point. In various embodiments, the reference point may be a location on one of the propulsion units 302, on the trailing edge of the wing 304, or any other desired portion of the aircraft 300. Thus, when the warning indicator 208 is flashing, the operator of a ground-based service vehicle or other apparatus operating in proximity to the aircraft 300 will be alerted to the fact that they are operating within the first selected distance from the specified portion of the aircraft 300, and may take extra precautions to avoid a collision.

Figure 1:
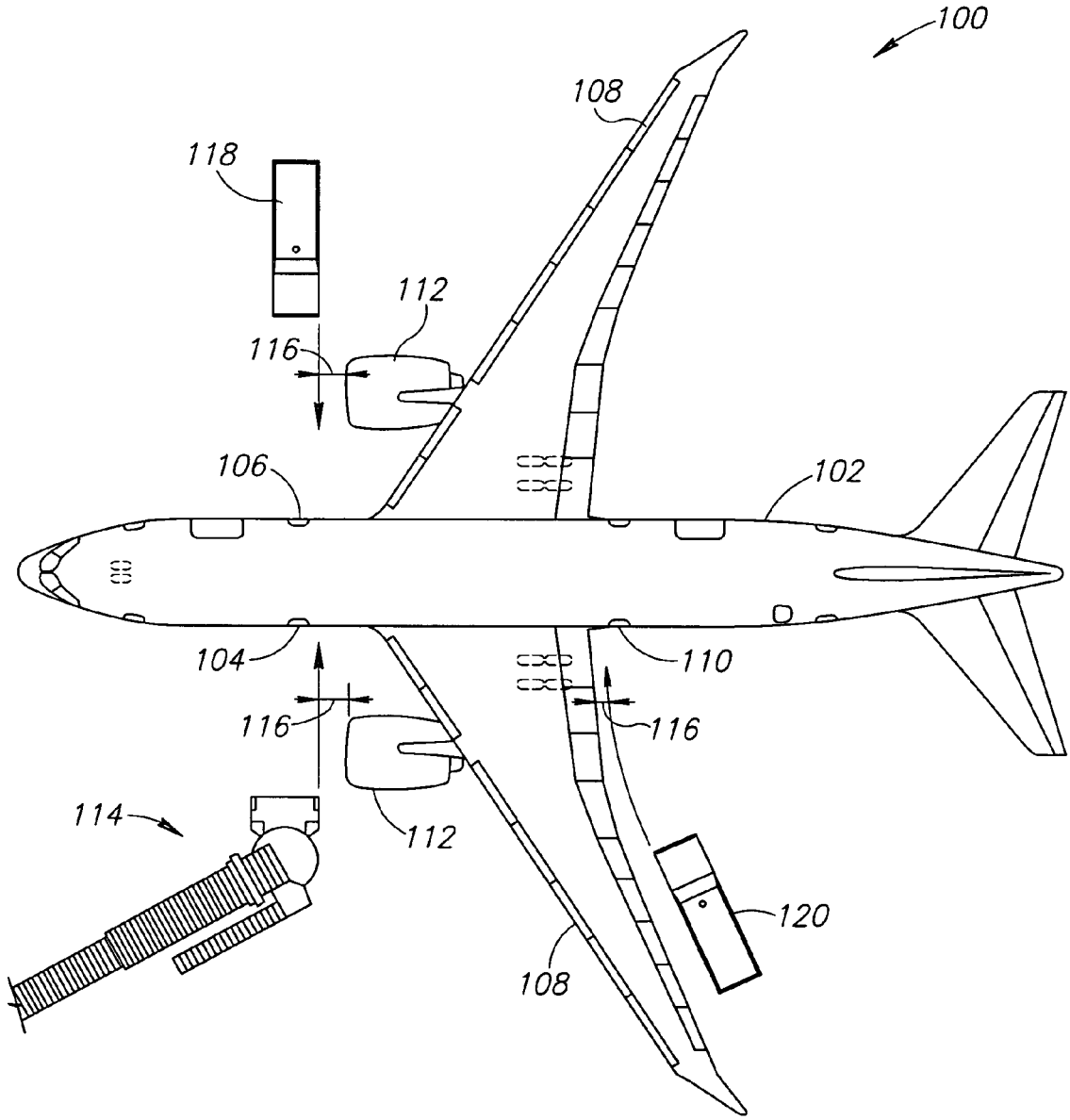
FIG.1 (PRIOR ART)
FIG. 1 is a top elevational view of an aircraft being serviced by ground support vehicles in accordance with the prior art.

More specifically, the operator of the passenger loading bridge 114 (FIG. 1) approaching the left forward door 104 may be alerted by the flashing warning indicator 108 that they have reached the critical clearance 116 between the passenger loading bridge 114 and the left propulsion unit 302. Similarly, the operator of the first and second galley trucks 118, 120 (FIG. 1) approaching the right forward door 106 and the left rear door 110, respectively, may be alerted by the flashing warning indicator 208 that they have reached the critical clearance 116 between the first and second galley trucks 118, 120 and the right propulsion unit 302 and the trailing edge of the left wing 304, respectively. When the warning indicators 108 show a constant illuminated (or audio) signal, the operators of the various ground-based vehicles may know that they are operating within a second selected distance, and may take appropriate action, such as stopping, making corrective maneuvers, seeking assistance from other ground personnel, or any other suitable action.

It will be appreciated that the laser scanner 202 (FIG. 2) may be any suitable type of laser scanner, including, for example, those systems commercially-available from Mensi, Inc. of Alpharetta, Ga. In alternate embodiments, however, the laser scanner 202 may be replaced with an alternate type of distance-determining device. For example, in alternate embodiments, the laser scanner 202 may be replaced with a laser radar system of the type generally disclosed, for example, in U.S. Pat. No. 5,202,742 issued to Frank et al., U.S. Pat. No. 5,266,955 issued to Izumi et al., and U.S. Pat. No. 5,724,124 issued to Kai, which patents are incorporated herein by reference. Alternately, a laser-based imaging system may be used, such as the Cyrax laser imaging system, commercially-available from Cyra Technologies, Inc. of San Ramon, Calif. In a further embodiment, a laser radar system may be used, including, for example, the LR200 laser radar system, commercially-available from Leica Geosystems, Inc. of Heerbrugg, Switzerland. In other embodiments, the distance-measuring device may be an infrared global positioning system (IRGPS), including those systems generally disclosed, for example, in U.S. Pat. No. 5,589,835 issued to Gildea et al., U.S. Pat. No. 6,452,668 B1, issued to Pratt, and U.S. Pat. Nos. 6,501,543 B2, 6,535,282 B2, 6,618,133 B2, and 6,630,993 B1 issued to Hedges et al., which patents are incorporated herein by reference. Such IRGPS systems are commercially-available from, for example, ARC Second, Inc.

of Dulles, Va. Alternately, the distance-measuring device may be a laser-based point tracking system of the type commercially-available from Automated Precision, Inc. of Rockville, Md., or any other suitable type of distance-measuring device.

Embodiments of systems and methods in accordance with the present invention may provide significant advantages over the prior art. For example, because the possibility of collisions between aircraft and ground-based vehicles is reduced, the costs associated with repairs, delayed flights, and dissatisfied customers is reduced. Furthermore, these desired results may be achieved without increasing the minimum clearance criteria around the aircraft, thereby allowing the use of conventional ground-based equipment and facilities.

While preferred and alternate embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. A method comprising performing ground-based service operations on an aircraft having a fuselage, nacelle and wings, the method including using a plurality of proximity warning devices on the aircraft to scan respective areas in front of selected portions of the nacelle, fuselage and wings of the aircraft while at least one ground-based service vehicle performs ground service operations on the aircraft; and warning a vehicle operator whose vehicle enters a scanned area and approaches a safety clearance of the aircraft.

2. The method of claim 1, wherein the proximity devices include laser rangefinders for scanning the respective areas and also for determining distances of the at least one of those ground-bases service vehicles within the scanned areas from the selected portions.

3. The method of claim 1, wherein determining the distance of a ground-based vehicle from a selected portion includes:

determining a first distance, and wherein providing the warning comprises providing a first warning signal, wherein the first warning signal includes either an intermittent warning signal or a constant warning signal;

determining a second distance between the ground-based vehicle and the selected portion using the proximity warning devices; and if the second distance does not exceed a second selected minimum distance, providing a second warning signal distinguishable from the first warning signal, wherein the second warning signal includes the other of the intermittent warning signal or the constant warning signal.

4. The method of claim 3, wherein the first and second warning signals are audible.

5. An aircraft, comprising:

a structural assembly including a fuselage, nacelles and wings; and a plurality of proximity warning devices operatively coupled to the aircraft for scanning respective areas in front of selected portions of the fuselage, nacelles and wings while ground-based service equipment is performing ground service operations on the aircraft, the selected portions susceptible to damage by the ground-based equipment during the ground service operations, each proximity warning device configured to determine:

a first monitored distance between an object positioned in the corresponding scanning area and the selected portion, and to provide a first warning signal when the first monitored distance does not exceed a selected minimum distance; and a second monitored distance between the object and the selected portion; and if the second monitored distance does not exceed a second selected minimum distance, to provide a second warning signal distinguishable from the first warning signal.

6. The aircraft of claim 5, wherein the proximity warning devices include a laser scanning system having a rotating lens element.

7. The aircraft of claim 6, wherein the laser scanning system includes:

a controller operatively coupled to a laser rangefinder adapted to emit a laser beam; and a scanning assembly adapted to receive the laser beam and to at least one of transmit, reflect, and refract the laser beam over the scanning area.

8. The aircraft of claim 5, wherein the monitored distance comprises a first monitored distance, and the warning signal comprises a first warning signal, and wherein the proximity warning device is further adapted to determine a second monitored distance between the ground-based device and the selected portion; and if the second monitored distance does not exceed a second selected minimum distance, to provide a second warning signal distinguishable from the first warning signal.

* * * * *